United States Patent [19]

Sommers et al.

[11] Patent Number: 4,457,704

[45] Date of Patent: Jul. 3, 1984

[54] METHOD FOR THE OPERATION OF A GAS BURNER EXPOSED TO AN AIR CURRENT AS WELL AS BURNERS TO IMPLEMENT THE METHOD

[75] Inventors: Hans Sommers, Essen; Hans Berg, Gladbeck, Theo Jannemann, Dorsten, all of Fed. Rep. of Germany

[73] Assignee: Ruhrgas Aktiengesellschaft, Essen, Fed. Rep. of Germany

[21] Appl. No.: 364,879

[22] Filed: Apr. 2, 1982

[30] Foreign Application Priority Data

Apr. 3, 1981 [DE] Fed. Rep. of Germany ..... 3113416

[51] Int. Cl.[3] ..... F24H 1/00; F23D 11/44; F23D 13/24

[52] U.S. Cl. ..... 432/29; 431/238; 431/350; 432/222

[58] Field of Search ..... 432/29, 222; 222/219; 431/238, 350

[56] References Cited

U.S. PATENT DOCUMENTS

| | | | |
|---|---|---|---|
| 3,273,621 | 9/1966 | Childree | 431/238 |
| 3,917,442 | 11/1975 | Zagoroff | 432/222 |
| 4,226,087 | 10/1980 | Spadaccini | 431/350 |

*Primary Examiner*—John J. Camby
*Attorney, Agent, or Firm*—Thomas E. Beall, Jr.

[57] ABSTRACT

The method and apparatus sucks the entire combustion air volume in laterally with respect to the direction of flow of the air current with the help of the impulse of a fuel gas jet out of the air current into a mixing pipe and the formation of a differential pressure between the mixing pipe input and the waste gas output into the air current is prevented with the help of current guidance sheet metal pieces. The burner is arranged in a shaft-like housing, the fuel gas nozzle and the lower part of mixing pipe are surrounded by a pot-shaped current guidance sheet metal piece. A cylindrical current guidance sheet metal piece adjoins the cooled burner plate. The burner which, for example, can be used in dryers, for heating room air with so-called make-up air units and in gas water heaters, operates completely independently of the air flowing around it in a wide heat load range, without any change in the air coefficient. Because of the super-stoichiometric premixing of the burning gas with the air, the $NO_x$ content of the waste gas is extraordinarily small.

25 Claims, 3 Drawing Figures

METHOD FOR THE OPERATION OF A GAS BURNER EXPOSED TO AN AIR CURRENT AS WELL AS BURNERS TO IMPLEMENT THE METHOD

BACKGROUND OF THE INVENTION

This invention relates to the method for operating a gas burner which is exposed to an air current, which consists of at least one gas nozzle, at least one conical mixing pipe and a burner plate, which is arranged in a shaft shaped housing and whose waste gas is mixed with the air current flowing through the housing, possibly after giving off heat to a heat exchanger, as well as burners for implementing the method.

The air current, to whose influence the burner is exposed, can, for example, be caused by a fan or by the draft in a chimney.

When drying laundry for household and commerical uses, when heating room or space air with so-called make-up air units or in the case of recirculated air baking ovens, the gas burner is used for the direct heating of a fan or blower air current by mixing the burner waste or exhaust gases with the air current.

SUMMARY OF THE INVENTION

Direct heating of an air current is very advantageous in energy terms because in this way the entire heat or caloric content of the waste gas is used which means that the fuel is being used up in an optimum fashion. But because the waste gases of hitherto employed free mixing burners, by virtue of the system involved, reveal a relatively large portion of noxious substances, especially $NO_x$, which could have a negative effect on the material coming in contact with the mixture of blower air and waste gas, the field of application of direct heating burners is limited.

Only a part of the air needed for combustion is supplied to the premixing burners used so far by means of the injector effect of the gas through the mixing pipe. The remaining air, needed for complete combustion, is diffused into the developing flames. If these burners are arranged directly in a blower air current, they can be operated only with a certain throughput volume of blower air and in most cases only in connection with a certain burner heat charge. Temperature changes in the blower air currents due to a change in the burner heat or caloric burden or charge or a change in the blower air volume are possible only within a narrow range because this brings about a change in the flame stability so that there is a danger that the burner might work unhygenically, that is to say, with incomplete combustion, or that the flames might go out.

A backwash or backpressure of the blower or fan air behind the burner, caused by obstacles in the air path, for example, the laundry to be dried, will likewise have a severely disturbing effect on the operation of the burner.

To avoid these disadvantages, the burner must be arranged outside the blower air current and that introduces a new disadvantages in that the heat, radiated from the burner housing, does not contribute to the heating of the air current. The caloric content in the fuel thus cannot be utilized fully to heat the air current. Besides, room must be available for the burner outside the blower air shaft and that often entails problems, especially in connection with household appliances.

For burners that are not arranged in the area influenced or covered by an air current or fan, it is possible to achieve a waste gas with a low noxious substance content in by supplying to the burner the entire combustion air needed prior to combustion, for example, through natural aspiration (vacuum effect) with the help of the gas impulse. Because these super-stoichiometrically premixing burners so far could not be operated in an air current influenced by external pressure or suction, especially when both the burner load and the air volume are supposed to be variable, the disadvantages listed in the preceding paragraph also apply to them.

In case of atmospheric burners (that is to say, burners without blowers), which are exposed to chimney draft, for example, in gas water heaters with direct chimney connection, there is a change in the volume of air which flows along the burner over the volume of air which gets into the suction range of the injector or injectors, along with the magnitude of the chimney draft which among other things changes due to atmospheric factors. The consequence is that the air coefficient of the burner fluctuates and this either leads to incomplete combustion or it causes a deterioration in the efficiency. There are, of course, possibilities of making the air volume flowing along the burner independent of the chimney draft, for example, by means of control or regulation of the air volume with the help of air flaps or valves; but these measures are expensive in terms of design and construction.

It is the purpose of the invention to create a pertinent method for the operation of a gas burner and a burner for the implementation of the method with which a waste gas poor in noxious substances, especially $NO_x$, is generated and which, regardless of the heat load of the burner as well as regardless of the flow speed or the throughput volume of the air in the housing, can achieve optimum combustion and utilization of the heat content of the fuel.

The burner should permit a high heat burden which must be variable within a broad range and it should be put together as compactly as possible and as simple as possible in terms of design.

These problems are solved by the measures and features of the present invention.

The invention teaches us first of all that we can suction a combustion air volume larger than the volume needed in keeping with the particular heat load only with the help of the impulse of the burner or fuel gas, flowing out of the gas nozzle into the mixing pipe, laterally with respect to the direction of flow of the air, out of the air current, and that one can prevent the development of a differential pressure between the mixing pipe input and the waste gas output into the air current with the help of current guidance sheet metal pieces.

Here is an essential feature of the method according to the invention: The effect of the air current upon burner operation can be eliminated and at the same time create a possibility for taking all of the needed combustion air volume from the air current prior to combustion. This is achieved in the following manner: in the burner according to the invention, by implementing the method, on the one hand, the gas nozzle and the mixing pipe input as well as the flames on the burner plate are protected against direct entry of air; on the other hand this is done in that the current profiles for the air are kept equally large and that in this matter the current velocity of the air or the flow speed of the air in the sector of the current guidance sheet metal piece can be kept almost identical. The last mentioned measure enables us to make sure that, within the current guidance sheet metal piece, that is to say, both in the surroundings of the mixing pipe input and on the flame side of the burner plate or at the waste gas input into the air current, regardless of the air current itself, the same pressure will prevail.

The burner can thus work completely independently of the volume or flow speed of the air flowing around it. Changes in the volume processing rate of air as well as congestions behind the burner have no effect whatsoever on the air volume suctioned in by the burner and consequently upon flame stability and complete final combustion. Consequently, the burner according to the invention can be operated in a wide heat load range without any change in the air coefficient and thus in the flame stability.

The burner has a burner plate which adjoins the mixing pipe, which consists of well heat conducting material, which reveals a large number of mixture passage openings, at least four openings per square centimeter, which are distributed over the entire burner plate cross section.

Particularly in the case of high performance burners we have, on the circumference of the burner plate, several cooling ribs made of well heat conducting material which protrude into the air current and which evacuate heat from the burner plate into the air or a cooling coil through which water flows, so that the burner plate temperature will remain almost constant.

Because of the complete premixing of the burner gas with an air volume larger than needed for complete combustion, the $NO_x$ content of the burner waste gas is extraordinarily small since the flame temperature is homogeneous and less than in burners where only a part of the needed combustion air is premixed with the gas. In cases where the waste gas is used for the direct heating of the air current, there is therefore no danger of a possible damage to the material or to persons coming into contact with the waste gas or the mixture of waste gas and air. Because the burner is arranged directly in the air current, the heat radiated from the burner housing contributes to the heating of the air current so that practically the entire caloric content of the combustion gas is used to heat the air current.

BRIEF DESCRIPTION OF THE DRAWINGS

The method according to the invention, advantageous designs of the object of the invention, and its operating procedure are now explained in greater detail below with the help of two practical examples illustrated in the drawing, wherein.

DETAILED DESCRIPTION OF THE PREFERRED EMBODIMENTS

Figure 2:
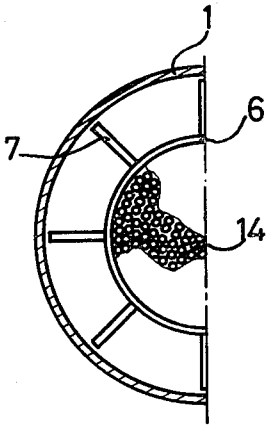
FIG. 2 is one-half of the cross section A-B in FIG. 1.
Figure 1:
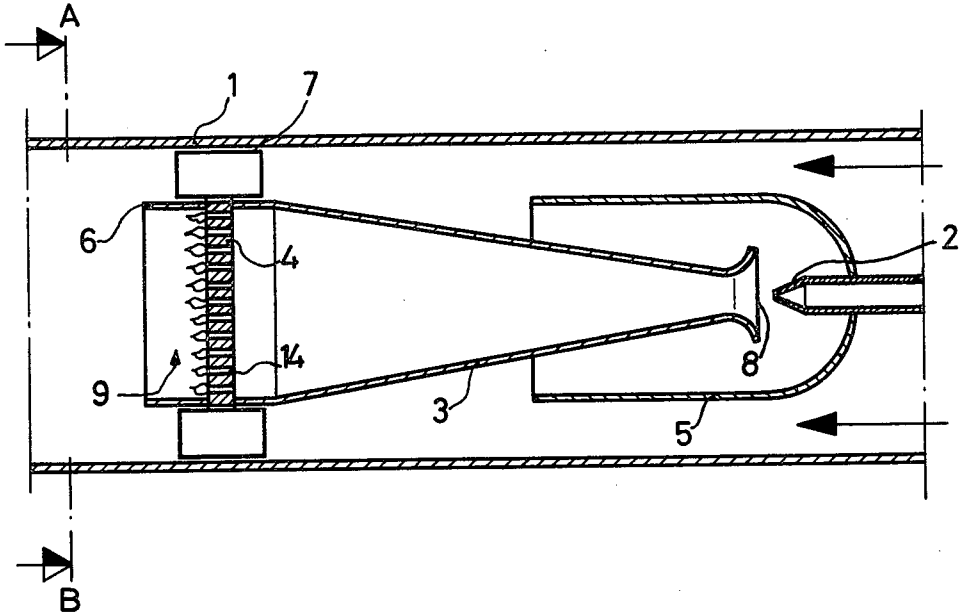
FIG. 1 is an axial cross section of a burner according to the invention.

In all figures, identical structural parts are labeled with the same reference numbers. The version illustrated in FIGS. 1 and 2, for example, can be used in a household drier. The burner is arranged concentrically in the cylindrical, horizontally positioned shaft shaped housing 1 which has flowing through it the drying air which must be heated and which is moved by a blower or fan not shown here.

The burner essentially comprises the fuel gas nozzle 2, the conical fuel gas and combustion air mixing pipe 3 with the entry opening 8, and the burner plate 4 joined across the outlet end of the mixing pipe 3. Burner plate 4 is constructed of good heat conducting material, for example, copper, and at a nominal heat load, has about 500 mixture passage openings 14 which are uniformly distributed over the entire burner plate profile covering an area of about 50 square centimeters. The perforations become slighly wider toward the side of the flames to guarantee good outflow performance.

The heat load on the burner plate is so great that the plate must be cooled to prevent its overheating and thus prevent a change in the air coefficient or a situation where the flames would beat back to the other side of the plate. Along the circumference of the burner plate there are, therefore, eight cooling ribs 7, which, likewise, are constructed of good heat conducting material, which ribs protrude into the air current and transfer the burner plate heat to the non-combustion air that passed outside of the mixing pipe. The burner plate temperature is in this fashion kept almost constant even in the case of any changes in the burner load. Other designs for the cooling ribs, other than those shown here, are also possible. For example the burner plate including the cooling ribs can be cast of one part.

Gas nozzle 2 and the entry end upstream part of mixing pipe 3 are surrounded by the air current guidance sheet metal piece 5, which includes a hemispherical upstream part and an adjoining cylinder mantle or casing downstream part. Another cylindrical air current guidance sheet metal piece 6, whose length is roughly three times the length of the flames, adjoins the burner plate 4. The diameter of both cylindrical current guidance sheet metal pieces 5 and 6 is equal to the diameter of burner plate 4 so that there will be equal free or clear flow profiles for the blower air which are annular areas when viewed as in FIG. 2 and formed by the current guidance sheet metal pieces 5 and 6 and the wall of housing 1. Therefore, the air flow speed in these profile areas of the current guidance sheet metal pieces will be about equal. In this way, there is eliminated the effect of the blower air on the burner. It is, therefore, possible to completely throttle the heat load of the burner independently of the blower air current down to less than 50% of its nominal heat load.

With the help of the impulse of the fuel gas jet from nozzle 2 entering the mixing pipe 3, the entire combustion air is sucked in laterally and in counterflow with respect to the direction of flow of the non-combustion air current. An air volume larger than the air volume needed for complete combustion as well as larger than the combustion gas now get, via mixing pipe 3, in which premixing takes place, to the burner plate 4, behind which the gas is burned up in the form of very short flames. A sufficiently large air supply can be guaranteed, for example, by making sure that the smallest diameter of the mixing pipe will be about 15 times the gas nozzle diameter when burning natural gas with an aperture angle of about 4° to 5°. Immediately before the burner plate 4, the mixing pipe 3 is made cylindrical for a short section or distance for the sake of the better and more thorough mixing of the mixture of fuel gas and combustion air. The air coefficient of the burner is about 1.05 to 1.35 depending upon the caloric value at a nominal heat load of 5 kilowatts when using natural gas.

The profile of the shaft shaped housing 1 of the burner parts and of the current guidance sheet metal pieces can deviate from the form described in the above example. In particular, the housing can have, for example, a rectangular or a conically widening cross section. In the first main case, the outer shape of the burner plate and the guidance sheet metal pieces can be made rectangular in keeping with the shape of the housing; a cylindrical design, however, is also possible. If the diameter of the housing changes in the area of the burner, the diameter of the current guidance sheet metal pieces must change accordingly, and, for example, in case of a conical widening, it must form a larger opening angle than the air shaft because otherwise the condition of identical current flow profiles for the blower air would not be met. The shaft-like housing need not be positioned horizontally, as in the preceding example, but can be arranged in any fashion depending upon the available space.

When the waste gas, that is, combustion products, can be moved only via the blower air current, there is a current flow surveillance device (not shown) for monitoring the blower air current and which will turn the burner off when air current is below a minimum air current.

Figure 3:
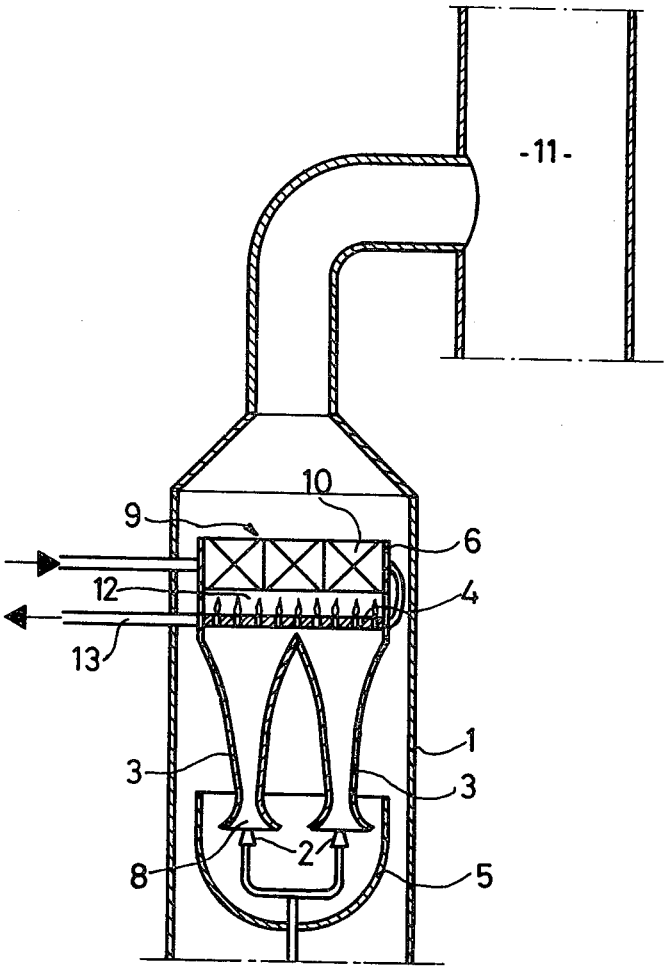
FIG. 3 is the axial profile of another burner design and arrangement according to the invention.

In the gas water heater, illustrated in FIG. 3, and directly connected to a waste gas chimney 11, (without current flow security, safety, or surveillance), the blower effect springs from the updraft or the draft of the waste gases in the chimney. In this case, there are two gas nozzles and two mixing pipe systems 2 and 3 which impact a common burner plate. Burner plate 4 is likewise cooled on the basis of the large surface heat stress or load, specifically with the help of the cooling coil 13, attached to the edge of burner plate 4, through which heated utility or heating water is already flowing as a cooling agent.

The air current guidance sheet metal piece 6 connects the burner with the heat exchanger 10 and is simultaneously the lateral limitation of the combustion chamber 12. Here, again, the air current guidance sheet metal pieces 5 and 6 prevent the evelopment of a differential pressure between the mixing pipe input 8 and the waste gas output 9 into the air current, in this case behind heat exchanger 10. In case of a perpendicular arrangement of the gas water heater, an updraft will tend to develop in the combustion chamber which will have an effect only on the burner surface but not on the air supply to the injectors and which thus will influence the air coefficient in case of changing load. This updraft can be prevented either through the horizontal arrangement of the gas water heater or it can be compensated for in other ways.

Housing 1 together with the air current guidance sheet metal pieces 5 and 6 according to the invention forms a constant free current flow cross section for the air. An air volume larger than the air volume needed for complete combustion is, in accordance with the invention, sucked in with the help of the fuel gas jets coming out of the gas nozzles 2, laterally with respect to the flow direction of the gas, complelely independently of the changing chimney draft.

In a gas water heater designed in this fashion, satisfactory performance if obtained without the otherwise necessary current flow security or safety or surveillance, as a result of which we can avoid its negative effects, particularly, the exit of waste gas into the place where the heater is set up. Current flow surveillance of the air current is required also in this version.

What is claimed is:

1. A method for operating a gas burner having at least one fuel gas nozzle, at least one mixing pipe, and a burner plate, all serially arranged in a air duct, formed as a tubular housing, said method comprising the steps of:

directing a fuel gas jet from the nozzle into the mixing pipe inlet so as to entrain ambient air into the mixing pipe for supplying combustion air thereto by the impulse effect of the gas jet;

guiding an air current substantially in one flow direction through the air duct so as to expose the gas burner to the air current;

diverting, at a point downstream with respect to the mixing pipe inlet, from the air current a combustion air volume larger than the air volume needed for complete combustion of the fuel gas, directing the diverted air volume laterally with respect to the flow direction of the air current and sucking the diverted air volume into the mixing pipe inlet, and the diverting, directing and sucking steps all being provided only by the impulse effect of the gas jet;

providing a combustion gas by mixing in the mixing pipe the diverted air volume with the fuel gas from the nozzle;

supplying the combustion gas to and passing it through passages in the burner plate;

generating a flame zone immediately downstream of the burner plate, with the flames in the flame zone providing waste gases of combustion for heating the air current;

combining and mixing the waste gases of combustion downstream of the flame zone with the remaining portion of the air current flowing through the duct; and selecting the profiles of the air current flowing around the burner through the duct so that the pressure adjacent the mixing pipe inlet and the pressure adjacent the waste gas outlet downstream of the flame zone are substantially equal throughout a wide range of flow of the air current.

2. The method according to claim 1, including;

guiding all of the air current in the air duct around and to downstream of the fuel gas nozzle and the inlet of the mixing pipe;

guiding all of the remaining portion of the air current, after the diverted air volume has been removed, exteriorally around the burner plate and to a point downstream of the flame zone prior to said step of combining and mixing; and said preceding two steps of guiding effectively prevent direct entry of air from the air current into the area of the burner plate and the area of the mixing pipe inlet so that changes in the air current do not affect the diverted air volume and do not affect the stability of the flame zone and thereby do not affect the complete final combustion.

3. The method according to claim 1, wherein said last mentioned steps of guiding provide respective air current profiles for the air being guided that are kept in a relationship to each other and the volume of air flowing therethrough so that the air flow speed can be kept almost identical so that the air pressure adjacent the downstream side of the burner plate is substantially the same as the air pressure in the area of the mixing pipe inlet regardless of the air current itself.

4. A gas burner, comprising:

means, including a tubular housing, for providing an air current in one direction through the housing;

gas nozzle means mounted within the housing for jetting fuel gas in said direction;

a mixing pipe having an upstream, with respect to the air current, opening immediately downstream from said fuel gas nozzle, an outlet spaced downstream from said inlet and a tubular wall connecting said inlet and outlet and diverging in the downstream direction;

guidance means mounted within said housing to envelope the outlet of said fuel gas nozzle means and said mixture pipe inlet, and being closed on its upstream end for guiding all of said air current between said guidance means and said housing past and spaced from said mixture pipe inlet and said fuel gas nozzle outlet to a point downstream from said mixture pipe inlet;

means forming a combustion air passage having an inlet laterally, with respect to the air current direction fluid communicating with said air current at said downstream point, and having an outlet upstream from its inlet that is immediately adjacent and in fluid communication with said fuel gas nozzle and said air mixture pipe inlet so as to provide substantially all of the combustion air to said mixing pipe by suction produced by said gas nozzle means jetting fuel into said mixture pipe inlet and providing said combustion air to said mixture pipe inlet substantially at a fixed pressure throughout a wide range of air current volume;

burner plate means mounted at the outlet of said mixture pipe and provided with a plurality of through mixture passage means passing substantially the entire mixture of combustion air and fuel gas through said plate to a downstream burning surface of said plate and generally preventing flame propagation upstream through said plate, to provide combustion gas products downstream of said plate; and guidance means for guiding said air current between said burner plate and housing to directly contact with and combine with said combustion products only downstream of said burner plate.

5. The gas burner of claim 4, wherein said fuel gas nozzle, said mixture pipe, each of said guidance means, and said burner plate are coaxially arranged within said housing to provide an annular generally fixed cross section air current passage.

6. The gas burner according to claim 5, wherein said burner plate is constructed of good heat conductive material, and further including means around the periphery of said burner plate for cooling said burner plate.

7. The gas burner according to claim 6, wherein said cooling means includes a plurality of heat transfer fins directly heat conductingly connected to said burner plate and within and in heat transfer direct contact with the air current passage.

8. The gas burner according to claim 6, wherein said cooling means comprises an indirect liquid heat exchange passage in direct contact with said burner plate.

9. The gas burner according to claim 8, further including a gas-liquid heat exchanger immediately downstream of said burner plate in liquid flow transfer with said cooling means, and combustion products guidance means provide a passage of all of said combustion products through said air-liquid heat exchanger.

10. The gas burner according to claim 4, wherein said burner plate is constructed of good heat conductive material, and further including means around the periphery of said burner plate for cooling said burner plate.

11. The gas burner according to claim 10, wherein said cooling means includes a plurality of heat transfer fins directly heat conductingly connected to said burner plate and within and in heat transfer direct contact with the air current passage.

12. The gas burner according to claim 10, wherein said cooling means comprises an indirect liquid heat exchange passage in direct contact with said burner plate.

13. The gas burner according to claim 12, further including a gas-liquid heat exchanger immediately downstream of said burner plate in liquid flow transfer with said cooling means, and combustion products guidance means provide a passage of all of said combustion products through said air-liquid heat exchanger.

14. The gas burner according to claim 11, wherein said fins are metal plates connected to and extending radially from said burner plate toward but spaced from said housing to permit air current to flow through the spacing between said fins and said housing.

15. The gas burner according to claim 4, wherein said second-mentioned guidance means is an annular pipe fluid sealed at its inlet upstream end to said burner plate and having a downstreamm outlet end that is sufficiently downstream to provide a combustion gas products flow immediately downstream from said burner plate that is substantially undisturbed by the air flow around the burner plate.

16. The gas burner according to claim 15, wherein said first-mentioned guidance means is of an imperforate cup shape opening downstream and having therein said fuel gas nozzle means, the inlet of said mixture pipe, and the upstream portion of said mixing pipe.

17. The gas burner according to claim 16, wherein said fuel gas nozzle means, each of said guidance means, said mixture pipe and said burner plate are generally coaxial and concentrically arranged inwardly spaced with respect to said housing.

18. The gas burner according to claim 4, wherein said first-mentioned guidance means is of an imperforate cup shape opening downstream and having therein said fuel gas nozzle means, the inlet of said mixture pipe, and the upstream portion of said mixing pipe.

19. The gas burner according to claim 18, wherein said fuel gas nozzle means, each of said guidance means, said mixture pipe and said burner plate are generally coaxial and concentrically arranged inwardly spaced with respect to said housing.

20. The gas burner according to claim 4, wherein said gas burner plate consists of a high heat conducting material having a plurality of through mixture passage openings in an amount of at least four openings per square centimeter of said burner plate distributed over the entire burner plate cross section that is perpendicular to the flow direction.

21. The gas burner according to claim 20, wherein said second-mentioned guidance means is tubular with an inlet end sealingly connected to the periphery of said burner plate downstream of said burner plate and having an outlet end spaced downstream from said burner plate by an amount within the range of 2 to 7 times the design flame zone of said burner plate.

22. The gas burner according to claim 21, wherein said range is 3 to 5 times.

23. The gas burner according to any one of claims 4, 20, 21, and 22, wherein said mixing pipe is conical, said burner plate, housing and second-mentioned guidance means are cylindrical, and said first-mentioned guidance means is hemispherical at its upstream end and cylindrical at its downstream end to provide a downstream opening cup-shape; and the diameter of each of said guidance means is substantially the same as the diameter of said burner plate.

24. The gas burner according to claim 4, wherein the ratio between the smallest diameter of the mixing pipe and the gas nozzle is matched with the fuel gas to provide a super-stoichiometric air volume diverted from the air current.

25. The gas burner according to claim 4, wherein said two guidance means provide air current flow profiles, respectively, around the mixture pipe inlet and the burner plate that are related to each other so that the air pressure will be substantially the same adjacent to the mixing pipe inlet and the downstream side of the burner plate independently of the air current flow.

* * * * *